US005335753A

United States Patent [19]

Campbell

[11] Patent Number: 5,335,753

[45] Date of Patent: Aug. 9, 1994

[54] COLLAPSIBLE SUPPORT STAND

[76] Inventor: Michael J. Campbell, 7986 Ingalls St., Arvada, Colo. 80003

[21] Appl. No.: 80,740

[22] Filed: Jun. 22, 1993

[51] Int. Cl.[5] ..... E04G 1/00

[52] U.S. Cl. ..... 182/181; 248/165; 248/174; 182/151

[58] Field of Search ..... 182/181–186, 182/224–227, 151; 220/510, 533, 534, 552; 248/165, 174, 150, 152

[56] References Cited

U.S. PATENT DOCUMENTS

| | | | |
|---|---|---|---|
| 293,847 | 2/1884 | Bremer . | |
| 2,347,821 | 5/1944 | Goldner . | |
| 2,592,561 | 4/1952 | Greenwood . | |
| 2,776,700 | 1/1957 | Potter et al. . | |
| 2,903,127 | 9/1959 | Dorman | 220/552 X |
| 2,955,647 | 10/1960 | Smith . | |
| 3,035,660 | 5/1962 | Leon . | |
| 3,250,570 | 5/1966 | Smith et al. . | |
| 3,788,700 | 1/1974 | Wartes | 297/442 |
| 4,105,091 | 8/1978 | Mahan | 182/181 |
| 4,182,432 | 1/1980 | Cossitt | 182/151 |
| 4,186,716 | 2/1980 | Baker et al. | 248/165 X |
| 4,433,753 | 2/1984 | Watson | 182/151 |
| 4,532,910 | 8/1985 | Longley, Jr. | 126/9 B |
| 4,574,917 | 3/1986 | Stoddard | 182/151 |
| 4,688,658 | 8/1987 | Stoner | 182/153 |
| 4,854,531 | 8/1989 | Esposito | 248/165 |
| 5,010,978 | 4/1991 | Jimmerson | 182/153 |
| 5,052,580 | 10/1991 | Khoury | 220/552 X |
| 5,167,433 | 12/1992 | Ryan | 220/533 |
| 5,197,169 | 3/1993 | Gordon | 248/165 X |

FOREIGN PATENT DOCUMENTS

| | | | |
|---|---|---|---|
| 1294663 | 11/1972 | United Kingdom | 248/174 |

*Primary Examiner*—Alvin C. Chin-Shue
*Attorney, Agent, or Firm*—James R. Young

[57] ABSTRACT

A support stand formed by a plurality of identical panels each having multiple slots which allow the panels to be assembled into a variety of different configurations or shapes. The panel is generally rectangular in shape, having at least two slots extending generally half way through the panels, with the slots being located on opposite corners. Optionally, a third slot is formed in the center of the panel parallel to one of the other two slots. The panels can have a recess that creates extensions at each corner that support a workpiece or form legs. A bracket can be mounted in grooves of each panel to hold a cutting guard.

10 Claims, 4 Drawing Sheets

COLLAPSIBLE SUPPORT STAND

FIELD OF THE INVENTION

This invention relates to support stands for a workpiece or work surface and more particularly to collapsible support stands. Even more particularly, the invention relates to a collapsible sawing stand that uses a plurality of identical panels.

BACKGROUND OF THE INVENTION

Support stands used by carpenters for sawhorses, stands used by painters for supporting a working platform, stands used for supporting temporary work tables, and similar structures are usually bulky and irregular in form so that a considerable space is needed for their transportation or storage. Sawhorses comprising a horizontally disposed member supported by legs are well known in the art. To form a stand, typically two sawhorses are positioned with the horizontal members of the sawhorses being parallel, and then a workpiece, such as a four by eight foot sheet of plywood, is placed on a top surface of the sawhorses. The workpiece may then be used as a work surface or it may be processed, such as by cutting or sawing. Desirably for good sawing, a rotary saw blade of the usual type of hand held rotary saw projects a short distance below a lower surface of the plywood during sawing. Care must be taken to avoid passing the saw over the sawhorses so that the blade will not cut the sawhorses. Also, once the cutting begins, the plywood tends to fall between the sawhorses unless there is assistance by an auxiliary support, such as a prop or a person holding the plywood.

Recent progress has been made in the art, for example, see U.S. Pat. No. 5,010,978 issued Apr. 30, 1991 to Jimmerson, entitled "Apparatus and Method For a Sawing Stand". In this device, three frames are hinged together to form a "Z" shape, and the hinges allow the frames to collapse for transportability while also allowing the device to be free standing. The device allows wooden boards or the like to be placed on top of each frame to act as cutting guards to prevent a saw from cutting the frames when sawing a workpiece. This device is limited, however, in that it can only form the one shape because of the attaching hinges, and is further limited in that all three pieces must be transported at one time since they are connected by the hinges.

More typical of the prior art, however, is U.S. Pat. No. 4,574,917 issued Mar. 11, 1986 to Stoddard, entitled "Three-Piece Knock-Down Sawhorse". This device uses three pieces to form a single sawhorse, and two sawhorses are needed to support a large workpiece, such as a sheet of plywood or drywall. This device is also limited, in that six pieces, three for each sawhorse, are needed to form a complete workstand, and it is further limited in that each sawhorse has four supporting legs, thus, requiring a level surface for each of the sawhorses used to form a workstand.

It is thus apparent that there is a need in the art for an improved support stand that is formed from a single panel type. A still further need is for such a support stand that can be formed into a variety of shapes to accommodate different types of workpieces. The present invention meets these and other needs.

SUMMARY OF THE INVENTION

It is an aspect of the present invention to provide a support stand for sawing and the like.

It is another aspect of the invention to provide such a stand that is collapsible.

Another aspect of the invention is to provide a collapsible stand made from a plurality of identical panels.

A still further aspect of the invention is to provide a collapsible stand made from a plurality of identical panels wherein a variety of different configurations can be formed from the plurality of identical panels.

The above and other aspects of the invention are accomplished in a workstand formed by a plurality of identical panels each having a plurality of slots which allow the panels to be assembled into a plurality of different configurations or shapes. The panel is generally rectangular in shape, having at least two slots extending generally half way through the panels, with the slots being located on opposite corners. Optionally, a third slot is formed in the center of the panel parallel to one of the other two slots.

These slots allow a plurality of the panels to be assembled into a variety of shapes, such as a zig zag or "Z" shape, an "X" shape, a "U" shape, a "T" shape, and many other shapes. Furthermore, a large number of the panels can be assembled together to form an extremely long work surface.

Alternatively, each panel may have a pair of recesses, one in each of the sides containing a slot, and these recesses provide a pair of legs for the side of the panel facing the ground, and also provide clearance for a saw blade being used to cut a workpiece placed on top of the panel.

In another embodiment, each panel has two pairs of grooves, one pair in each surface containing one of the slots. A bracket is designed to fit into the grooves, and the top surface of the bracket is designed to hold a cutting guard, such as a piece of wood. This cutting guard can be used to provide a higher surface for the stand or to protect the stand by preventing a saw from extending into the stand when a workpiece is being cut.

BRIEF DESCRIPTION OF THE DRAWINGS

The above and other aspects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
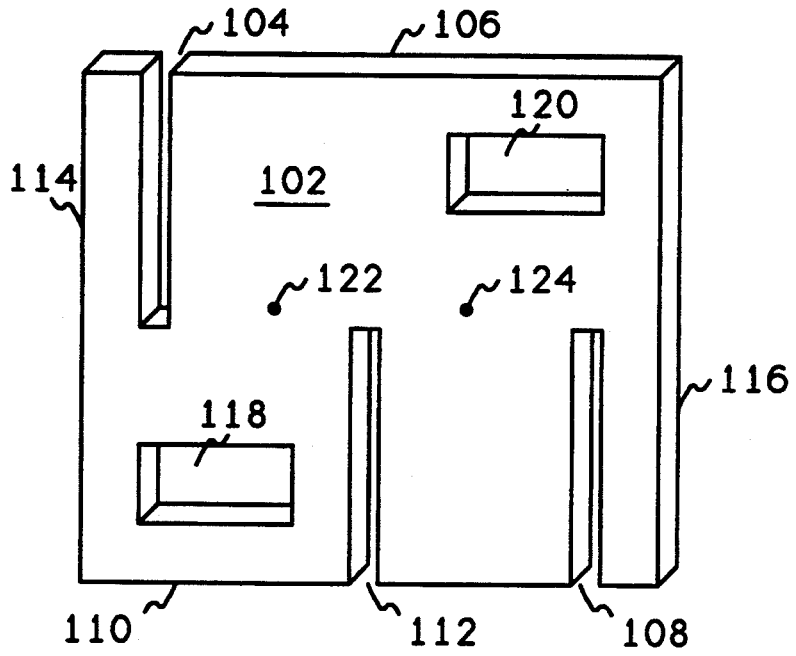
FIG. 1 shows a front view of a panel used to construct the stand of the present invention.

FIG. 1 shows a front perspective view of a panel used to construct the stand of the present invention. Referring now to FIG. 1, a panel 102, generally rectangular in shape, and often square in shape, is used as the basic building block for the stand of the present invention. The panel 102 contains a pair of slots 104 and 108 located in opposite edges 106 and 110 of the panel 102. The slots 104 and 108 are also located near opposite corners of the panel 102. Furthermore, the slots 104 and 108 are located at an equal distance from respective edges 114 and 116, so that the panel 102 with the slots 104 and 108 forms a symmetric device, which can turned over to allow it to mate with a similar panel on either edge.

Optionally, a third slot 112 is formed into the edge 110 of panel 102 such that the slot 112 is at an equal distance from edges 114 and 116, thus, it is in the middle of edge 110 of the panel 102.

Holes 118 and 120 are also symmetrically placed in the panel 102 to act as handles when combining or separating the panel 102 with other panels formed in the same manner as panel 102. Bolt holes 122 and 124 are used to fasten multiple panels together for transport or storage.

The slots 104, 108, and 112 extend approximately half way from one edge to another of the panel 102 and are approximately the same width as the thickness of panel 102. These slots allow two or more of the panels 102 to be combined to form a variety of shapes such that the combination of the panels will be freestanding and capable of supporting a workpiece or work surface.

Figure 2:
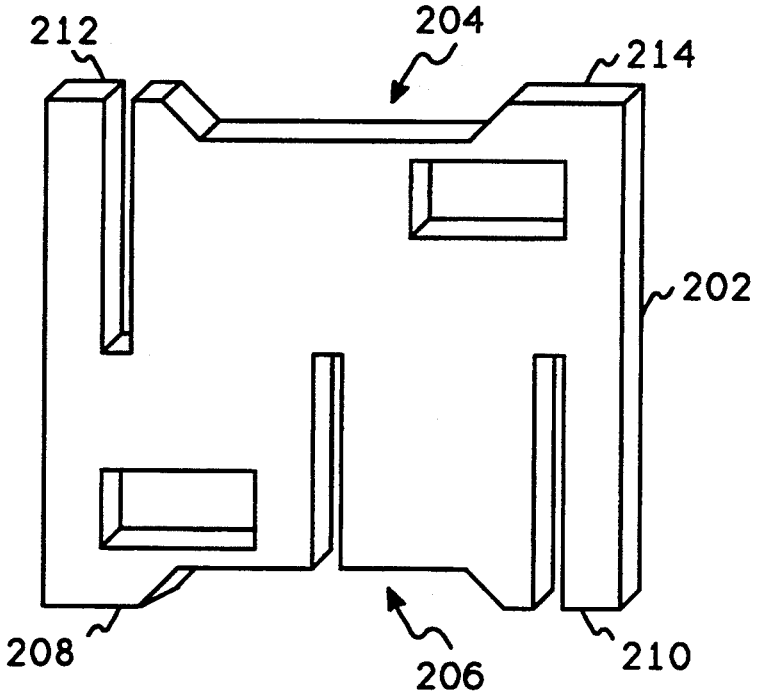
FIG. 2 shows an alternative embodiment of the panel of FIG. 1 wherein the panel has legs.

FIG. 2 shows an alternative embodiment of the panel of FIG. 1. Referring now to FIG. 2, a panel 202, similar in shape to the panel 102 (FIG. 1), further contains a pair of recesses, 204 and 206. The recesses 204 and 206 cause the panel to be formed such that four extensions 208, 210, 212, and 214 are formed in the panel 202. Two of these extensions form a pair of legs 208 and 210 for the edge of the panel 202 that faces downward, and the other two extensions form workpiece supports for the edge of the panel 202 that faces upward. The legs 208 and 210 allow the panel to sit more evenly on uneven surfaces. For the edge of the panel that faces upward toward the workpiece, extensions 212 and 214 support the workpiece so that recess 204 provides a space underneath the workpiece that allows room for a saw blade to pass through the workpiece without damaging the panel 202.

The recesses 204 and 206 are identical in depth and length and are centered within the edge of the panel, thus, the extensions 208, 210, 212, and 214 formed by the recesses 204 and 206 are symmetrical to allow the panel to be reversed.

Figure 3:
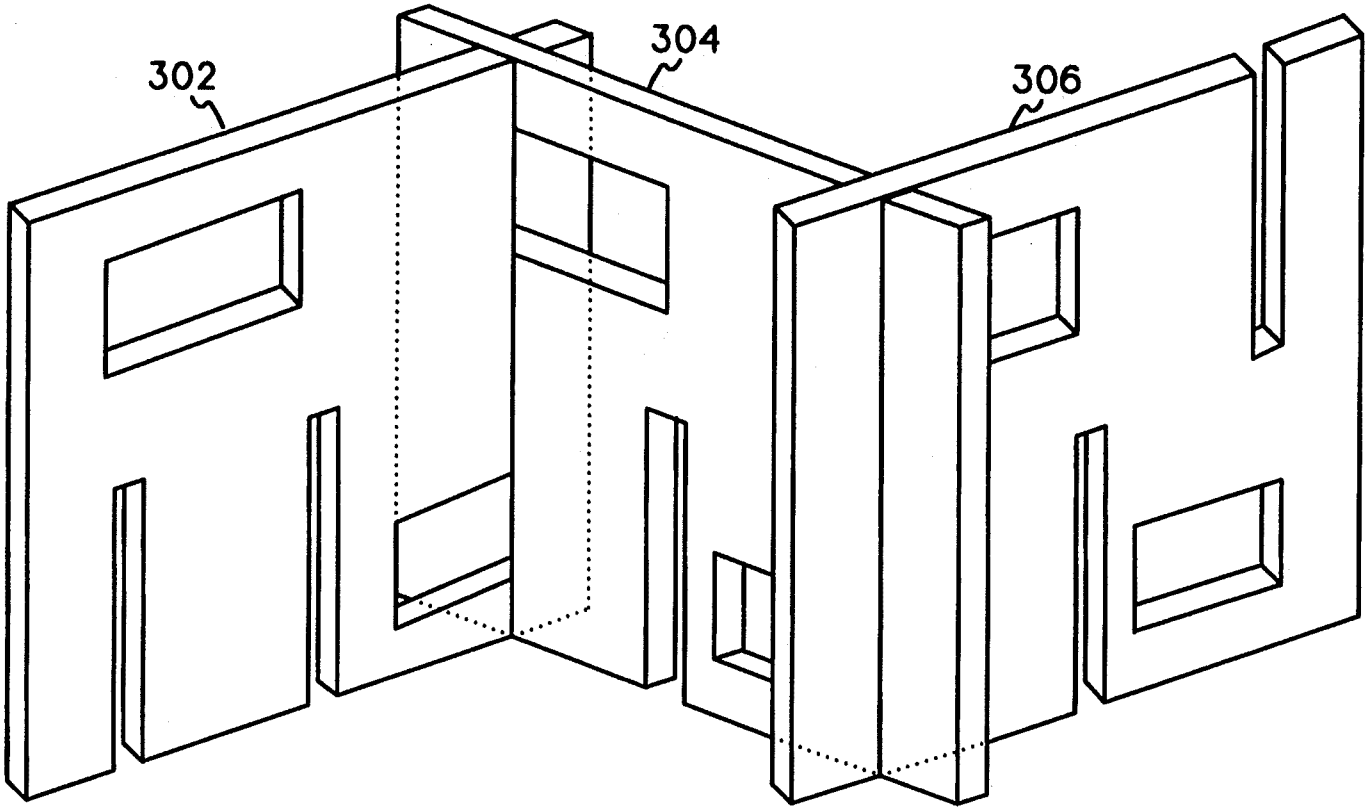
FIG. 3 shows a perspective view of a stand constructed with the panels of FIG. 1.

FIG. 3 shows a perspective view of a stand constructed using the panels of FIG. 1 or FIG. 2. Referring now to FIG. 3, a panel 302, identical to panel 102 of FIG. 1, is combined with a second panel 304 which is also identical to the panel 102 of FIG. 1. Panel 302 and 304 are connected together by mating slot 104 of the panel 302 with slot 108 of the panel 304. A third panel 306, also identical in shape to panel 102 of FIG. 1, is combined with panel 304 by mating slot 104 of panel 304 with slot 108 of panel 306. By combining the three panels 302, 304 and 306 in the manner of FIG. 3, a "Z" shape is formed which will allow a workpiece, such as a sheet of plywood or drywall to set comfortably across the top of the stand formed by the panels 302, 304, and 306. The stand thus formed could be extended indefinitely by connecting additional panels to 306 in a similar manner to make a stand of an arbitrary length.

If panels 302, 304, and 306 are panels shaped in the manner of panel 202 of FIG. 2, a recess is formed along the entire length of the stand formed by the panels 302, 304, and 306, to allow space for a cutting blade of a saw to extend below a workpiece such as a sheet of plywood described above, and allow the workpiece to be cut without damaging the stand.

Figure 4:
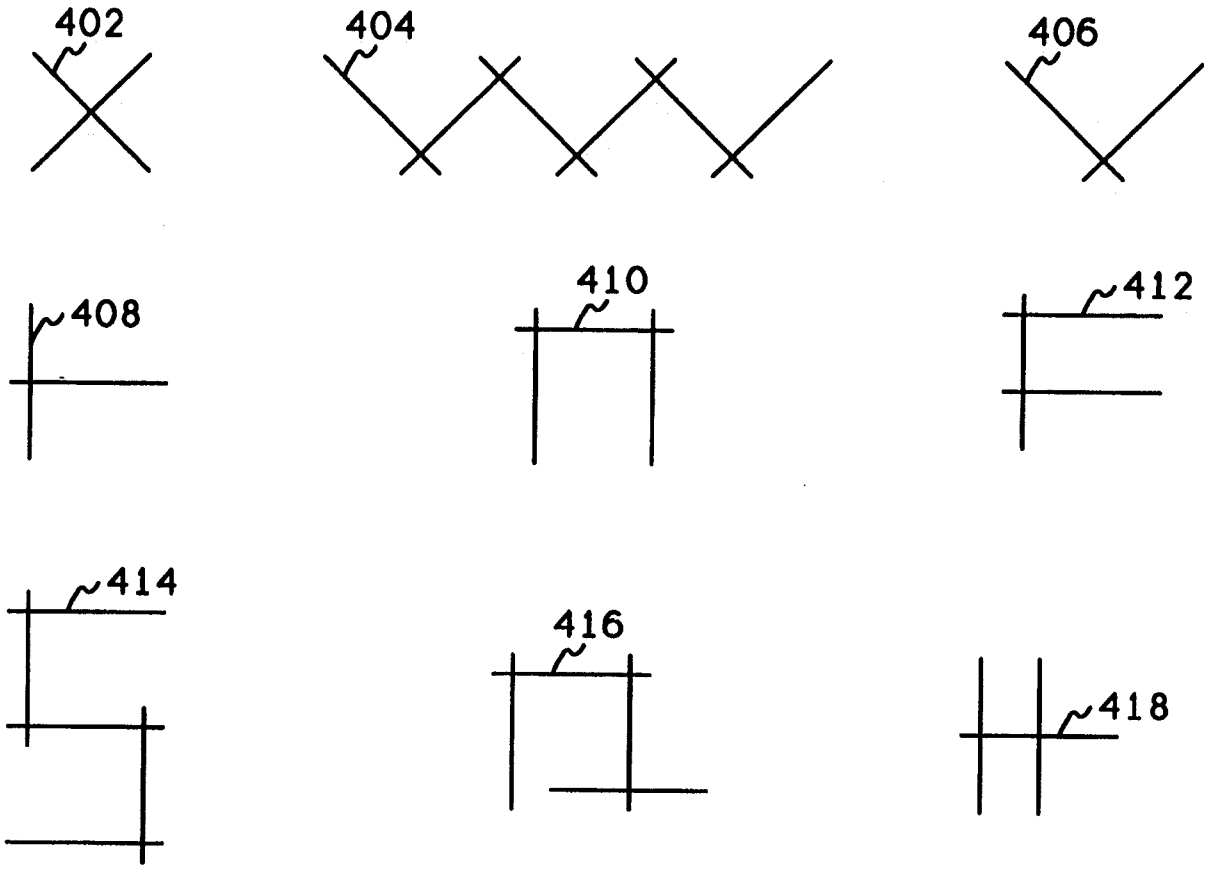
FIG. 4 shows a variety of stand configurations that can be formed using a plurality of panels in the shape of FIG. 1.

FIG. 4 shows a variety of stand configurations that can be formed using a plurality of panels shaped like the panel of FIG. 1 or the panel of FIG. 2. Referring now to FIG. 4, diagram 402 shows that the panels can be combined into an "X" shape by mating the panels using slot 112 of both panels. Diagram 404 shows an extension of the stand shown in FIG. 3 and indicates that a stand configuration of this form can be of arbitrary length. Diagram 406 shows a "V" shape and diagram 408 shows the panels formed into a "T" shape. Diagrams 410 through 418 show some of the many other possible shapes that can be formed from the panel.

Figure 5:
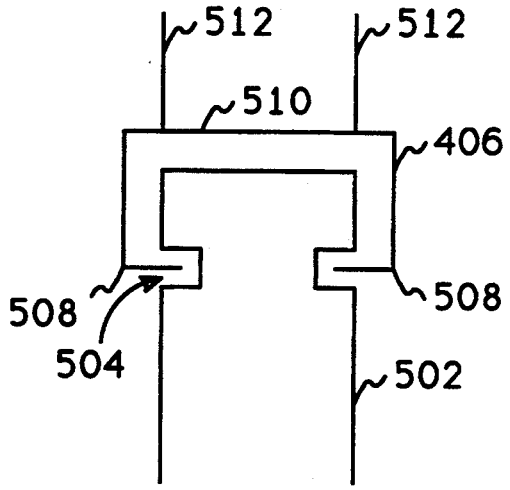
FIG. 5 shows a bracket that attaches to the panel of FIGS. 1 or 2 to hold a cutting guard on the top of a panel.

FIG. 5 shows a bracket that attaches to the panel of FIG. 1 or FIG. 2 to hold a cutting guard on the top of a panel. A cutting guard would be used to prevent damage to the panel when cutting through a workpiece. If the depth of the recess 204 (FIG. 2) is insufficient as a cutting guard, additional material, such as a 2"×4" piece of wood, can be attached to the top of a panel. FIG. 5 shows a bracket used to attach such a cutting guard.

Referring now to FIG. 5, a panel 502 is similar in shape to the panel 102 (FIG. 1) except that it has a pair of longitudinal grooves 504 running lengthwise along the top surface of the panel. A bracket 506 is formed generally into a "U" shape with extended edges 508 that fit into the groove 504. Along a top surface 510 of the bracket 506, a pair of extensions 512 extend upward to form a slot into which a cutting guard can be placed. The bracket 506 would not be long enough to extend entirely across the surface of a panel, instead the bracket 506 would extend only a very short distance across the surface and two such brackets would be placed in each panel, one at each end. Thus, each of the brackets at each end of a panel would hold the cutting guard in place along the top surface of the panel.

Figure 6:
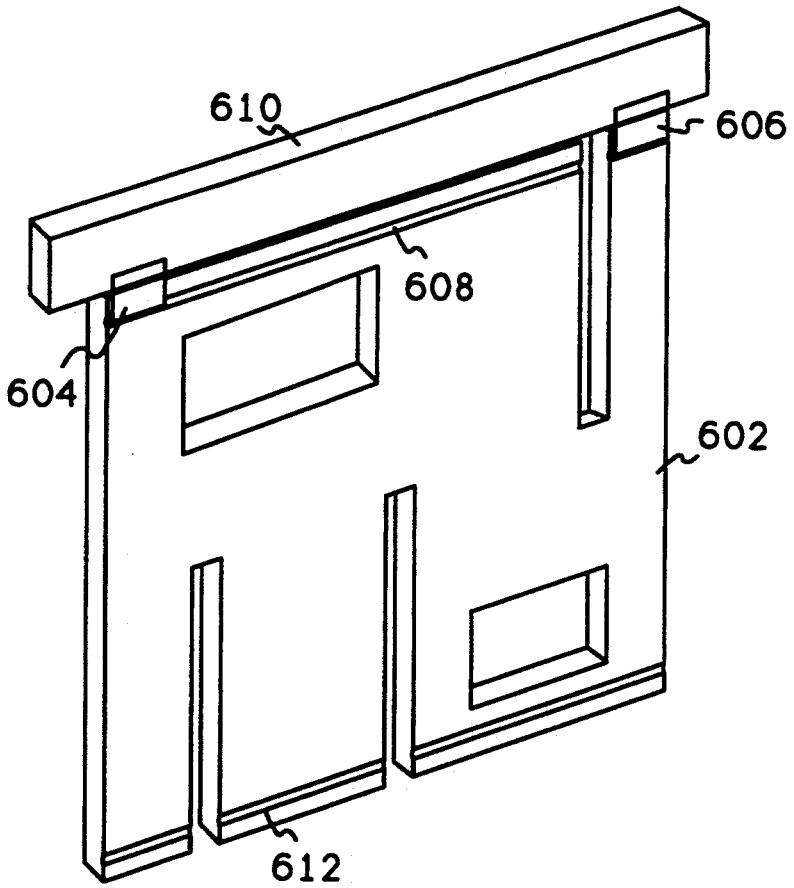
FIG. 6 shows a panel with brackets and a cutting guard attached to the top of the panel.

FIG. 6 shows a panel having brackets at each end of the top surface of the panel with a cutting guard being held within the brackets. Referring now to FIG. 6, a panel 602 has grooves 608 and 612 at the top and bottom edges respectively of the panel. A pair of brackets 604 and 606 are mounted in the top groove 608, and a cutting guard 610, for example a 2×4 section of wood, is in place on top of the brackets 604 and 606. As discussed above, this cutting guard could be used to protect the top of the panel 602 from damage during cutting of a workpiece (not shown), or it could be used to raise the level of the workpiece.

As an alternative to the bracket 506, cutting guards could be attached to the top surface of the panels via other methods, such as screws, velcro, etc.

Having thus described a presently preferred embodiment of the present invention, it will now be appreciated that the aspects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. A workpiece supporting stand for supporting a workpiece horizontally, said stand comprising:

a first panel having a generally rectangular shape with two slots therein, wherein said slots are located on opposite edges of said panel, adjacent opposite corners of said panel, and further wherein said slots are substantially the same width as a thickness of said panel, said panel further comprising a pair of grooves, located adjacent a panel edge containing a slot, wherein one groove of said pair is located on a side of said panel opposite a side of said panel containing the other groove of said pair; and at least one bracket mounted in said pair of grooves; and a second panel, identical in shape to said first panel, and connected to said first panel by mating one of said at least two slots of said first panel to one of two slots of said second panel.

2. The workpiece supporting stand of claim 1 wherein said first and second panels each further comprise a third slot located on a same edge as one of said two slots, and located substantially in a center of said same edge.

3. The workpiece supporting stand of claim 1 wherein said first and second panels each further comprise a pair of openings located adjacent opposite corners of said panels and located adjacent corners farthest away from said slots.

4. The workpiece supporting stand of claim 1 wherein said first and second panels each further comprise a pair of recesses, one recess in each of said edges containing said slots, said recesses being located substantially in a center of each of said edges.

5. The workpiece supporting stand in claim 1 wherein each of said slots extend substantially half the length of a shorter edge of said first and second identical panels.

6. A workpiece supporting stand for supporting a workpiece horizontally, said stand comprising at least two identically shaped panels connected together into one of a plurality of shapes, each of said identically shaped panels having a generally rectangular shape with two slots therein, wherein said slots are located on opposite edges of each of said identically shaped panels, adjacent opposite corners of each of said identically shaped panels, and wherein said slots are substantially the same width as a thickness of each of said identically shaped panels, said identically shaped panels further comprising a pair of grooves, located adjacent a panel edge containing a slot, wherein one groove of said pair is located on a side of said panel opposite a side of said panel containing the other groove of said pair, and at least one bracket mounted in said pair of grooves, and still further wherein said identically shaped panels are connected together by mating one of said two slots in each of said identically shaped panels to one of said two slots in another of each of said identically shaped panels.

7. The workpiece supporting stand of claim 6 wherein each of said at least two identically shaped panels further comprises a third slot located on a same edge as one of said two slots, and located substantially in a center of said edge.

8. The workpiece supporting stand of claim 6 wherein each of said at least two identically shaped panels further comprises a pair of openings located adjacent opposite corners of said panel and located adjacent corners farthest away from said two slots.

9. The workpiece supporting stand of claim 6 wherein each of said at least two identically shaped panels further comprises a pair of recesses, one of said pair of recesses in each of said edges containing said slots, said recesses being located substantially in a center of each of said edges.

10. The workpiece supporting stand of claim 6 wherein each of said slots in each of said at least two identically shaped panels extends substantially half the length of a shorter edge of each of said at least identically shaped panels.

* * * * *